US005543690A

United States Patent [19]

Bernicke et al.

[11] Patent Number: 5,543,690

[45] Date of Patent: Aug. 6, 1996

[54] HIGH VOLTAGE IGNITION CIRCUIT FOR A DISCHARGE LAMP

[75] Inventors: Erhard Bernicke; Klaus Rohr, both of Berlin; Karl Eibisch, Zeuthen, all of Germany

[73] Assignee: Prolux Maschinenbau GmbH, Berlin, Germany

[21] Appl. No.: 196,087

[22] PCT Filed: Jun. 19, 1992

[86] PCT No.: PCT/DE92/00514

§ 371 Date: Feb. 18, 1994

§ 102(e) Date: Feb. 18, 1994

[87] PCT Pub. No.: WO93/00784

PCT Pub. Date: Jan. 7, 1993

[30] Foreign Application Priority Data

Jun. 21, 1991 [DE] Germany ..... 41 21 009.3

[51] Int. Cl.[6] ..... H05B 37/00

[52] U.S. Cl. ..... 315/224; 315/209 R; 315/227 R; 315/241 R; 315/244; 315/245

[58] Field of Search ..... 315/224, 209 R, 315/235, 234, 227 R, 232, 244, 245, 242, 241 R, 101, 105, 106, 107, 309

[56] References Cited

U.S. PATENT DOCUMENTS

| | | | |
|---|---|---|---|
| 4,647,820 | 3/1987 | Chermin et al. | 315/245 |
| 4,935,672 | 6/1990 | Lammers et al. | 315/DIG. 7 X |
| 4,952,842 | 8/1990 | Bolhius et al. | 315/106 |
| 5,027,033 | 6/1991 | Zuchtriegel | 315/106 |

FOREIGN PATENT DOCUMENTS

| | | |
|---|---|---|
| 380373 | 5/1986 | Austria . |
| 0430357A1 | 6/1991 | European Pat. Off. . |
| 3805510A1 | 8/1989 | Germany . |
| 3840845A1 | 6/1990 | Germany . |

*Primary Examiner*—Robert Pascal
*Assistant Examiner*—Haissa Philogene
*Attorney, Agent, or Firm*—Christie, Parker & Hale, LLP

[57] ABSTRACT

The invention relates to a circuit arrangement for operating a discharge lamp. According to the invention the series connection of a PTC thermistor V1 with a bi-directionally acting breakdown voltage component V2 is disposed parallel to the inductance L1 and/or the capacitor C1 in a load circuit which has a discharge lamp H1, an inductance L1 connected in series with the discharge lamp and a capacitor C1 disposed parallel to the discharge lamp H1, wherein the PTC thermistor V1 and the bi-directionally acting breakdown voltage component V2 are thermally coupled. The object of the invention is to provide a simple circuit arrangement for operating a discharge lamp which allows a substantially constant ignition of a discharge lamp.

10 Claims, 1 Drawing Sheet

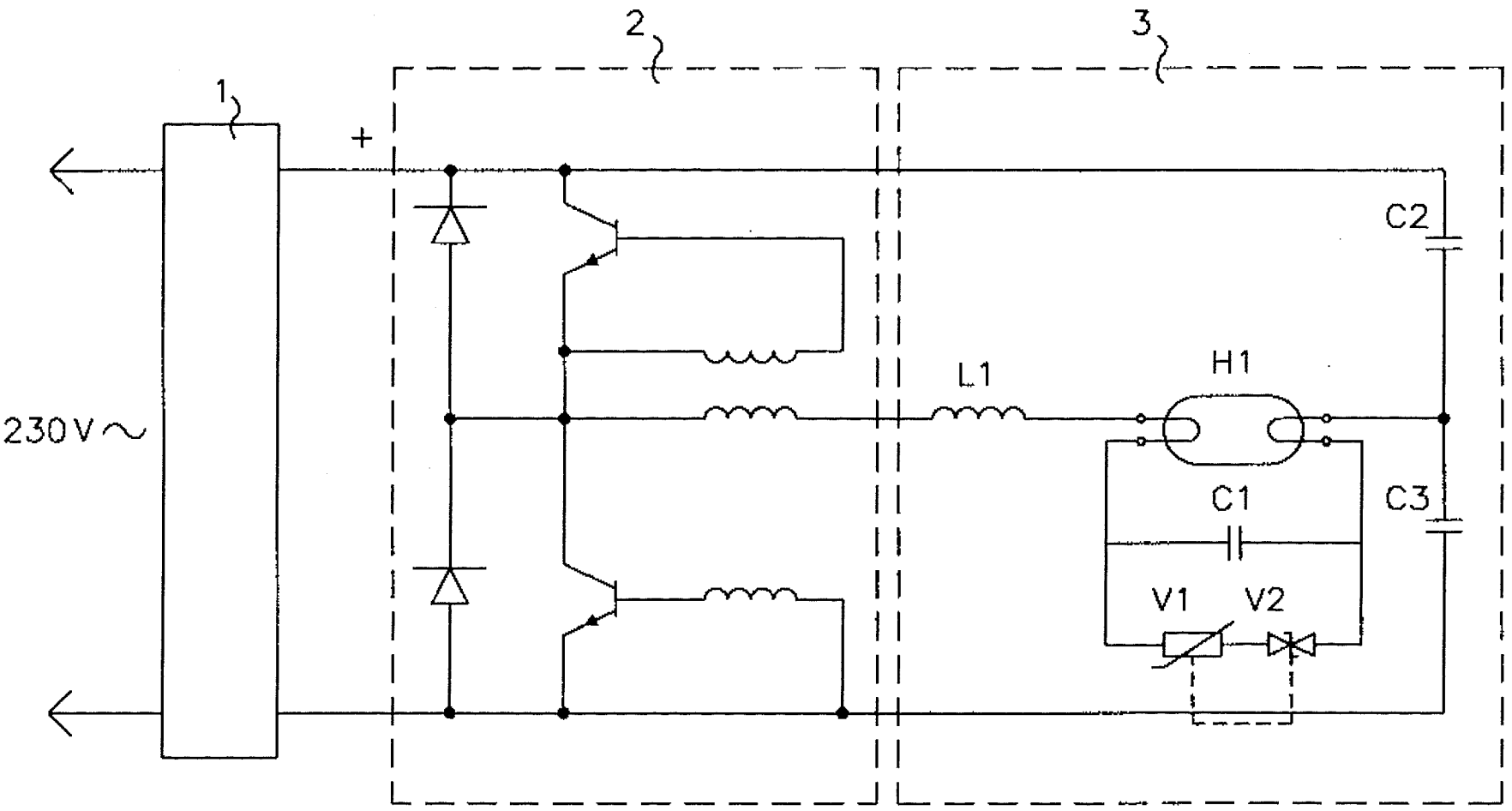
3
2
1
C2
C3
H1
C1
V2
V1
L1
+
230V~

HIGH VOLTAGE IGNITION CIRCUIT FOR A DISCHARGE LAMP

BACKGROUND OF THE INVENTION

The invention relates to a circuit arrangement for operating a discharge lamp, preferably a low pressure discharge lamp, with a high frequency inverter or frequency changer, in inductance connected series with the discharge lamp and a capacitance arranged parallel to the discharge lamp.

The operation of a discharge lamp includes all states of a discharge lamp from preheating to ignition and steady burning, i.e., combustion.

Low pressure discharge lamps, particularly fluorescent lamps, are used to a large extent for the generation of electric light. Compared to incandescent lamps they have a higher light intensity, a greater degree of efficiency and a longer service life.

Low pressure discharge lamps essentially comprise a discharge vessel, which in the case of fluorescent lamps is coated on the inside with a luminous substance, electrodes, a gas filling and a lamp socket with contact pins. With discharge lamps the light is generated by the process of a gas discharge in the discharge vessel.

Owing to its negative inner resistance, it is not possible to connect low pressure discharge lamps directly to a supply grid. Rather it is necessary to connect an auxiliary unit between the supply grid and low pressure discharge lamp so that this unit regulates the ignition and operation of the lamp.

There are various possibilities of creating auxiliary units which basically differ in the way in which the ignition of the lamp is carried out. Auxiliary units where the electrodes are preheated before the ignition of the gas are the most widespread.

In these types of auxiliary units the gas discharge is ignited by a voltage pulse. The conventional auxiliary units use a glow starter to produce voltage pulses. At the present time auxiliary units are preferably made with purely electronic components. This particularly applies to compact lamps wherein the auxiliary unit is integrated into the lamp socket within the smallest possible space. Compact lamps have small dimensions compared with the conventional tube-like fluorescent lamps.

Electronic auxiliary units are known. They basically comprise a low pass filter, a radio interference suppressor filter, a rectifier and a DC/AC or frequency converter. The DC/AC or frequency converter produces a high frequency alternating voltage of about 25 to 50 kHz which is applied to the electrodes of the discharge lamp. When a low pressure discharge lamp is operated with a high-frequency alternating voltage the lamps produce a higher light output than during low-frequency operation. Also the light produced with this type of operation is flicker-free.

German laid open application 3840845 A1 describes a circuit arrangement for operating a low pressure discharge lamp with an inductance connected in series with the discharge lamp and a capacitance arranged parallel to the discharge lamp. In this case, a two-pole is provided parallel to the inductance and is connected on one side to a switching point of the load circuit and on the other side via at least one diode to the positive pole and/or via a diode to the negative pole of a DC voltage source for supplying the circuit arrangement. The diodes cause a blockage of the preheating circuit after the ignition of the discharge lamp. With arc voltages of the discharge lamp of more than 70 V, the two-pole consists of a series circuit of a PTC thermistor and two Z-diodes polarized in the opposite flow-through direction. This serves to safeguard the blockage of the preheating circuit in case of arc voltages of more than 70 V.

From U.S. Pat. No. 4,647,820 a circuit arrangement is known for operating a discharge lamp which comprises a DC/AC converter for producing a high-frequency operating voltage for the discharge lamp, an inductance connected in series with the discharge lamp, a capacitance disposed parallel to the discharge lamp and a PTC thermistor disposed parallel to the capacitance. With this known circuit arrangement there is the disadvantage that even after ignition of the discharge lamp current flows through the PTC thermistor which accelerates aging of the PTC thermistor.

With the known circuit arrangement the starting characteristics of the discharge lamp are determined by the ambient temperature and the operating data of the PTC thermistor which change with age so that a constant ignition of a discharge lamp is not possible with the known circuit arrangements.

SUMMARY OF THE INVENTION

The object of the invention is based on providing a simple circuit arrangement according to the preamble of the first claim for the gentle operation of a discharge lamp which allows a substantially constant ignition of a discharge lamp.

According to the invention this objective is attained in that the series connection of a PTC thermistor with a achieved bi-directional breakdown voltage component is disposed parallel to the inductance or to the capacitance of a circuit arrangement which has a high-frequency DC/AC or frequency converter, an inductance connected in series with the discharge lamp, and a capacitance disposed parallel to the discharge lamp, and that the PTC thermistor and the bidirectional breakdown component are thermally connected to each other, and that the degree of the thermal coupling can be set with precision.

The objective in accordance with the invention provides a simple circuit arrangement for the gentle operation of a discharge lamp, more particularly a low pressure discharge lamp, by causing a voltage limitation in the preheating phase of the lamp and thus preventing a spontaneous ignition of the discharge lamp through a resonant rise in the load circuit.

The precision set thermal coupling of the PTC thermistor and bidirectional breakdown voltage component leads to additional heating of the PTC thermistor through the waste heat of the bidirectionally acting breakdown voltage component. The effect of the heat supply by the bidirectional breakdown voltage component is, in particular, that the change in the operating data of the PTC thermistor through aging and the ambient temperature only has a very reduced effect on the starting characteristics of the discharge lamp and thus a substantially constant ignition of the discharge lamp is guaranteed.

The objective of the invention is based on the following knowledge:

The inductance and a capacitor provided as the capacitance form a series resonant circuit. In the preheating phase, current flows through the PTC thermistor and the bidirectional breakdown voltage component so that these are heated.

As the PTC thermistor becomes warmer, its resistance increases so that increasingly voltage drops off via the PTC thermistor and in the process the bidirectional breakdown voltage component acts to restrict the voltage. Furthermore, as the PCT thermistor becomes warmer the resonance rise in the series resonant circuit formed by inductance and capacitor rises until the discharge lamp ignites.

In an advantageous embodiment of the invention the degree of thermal coupling of the PCT thermistor and bidirectional breakdown voltage component can be set with precision. A precise adjustment of the starting characteristics of the discharge lamp is thereby possible.

During the heating phase of the lamp the bi-directional breakdown voltage component is biased with a high power loss which via the thermal coupling leads to a specific additional heating of the PTC thermistor and thus, corresponding to the degree of thermal coupling, sooner or later to a resonance rise in the series resonant circuit and to ignition of the discharge lamp. By setting the degree of thermal coupling of the PTC thermistor and bidirectional voltage breakdown component it is possible to achieve a precise adjustment of the starting characteristics of the lamp. More particularly, it is possible to easily adapt the heating time to different lamp characteristic values by means of the circuit arrangement according to the invention.

The thermal coupling between the PTC thermistor and the bidirectional breakdown voltage component is advantageously carried out by a connecting medium. Adhesives or varnish, for example, are suitable as a connecting medium. In this case, the degree of thermal coupling can be adjusted in particular through a corresponding choice of the connecting medium. An adjustment of the thermal coupling can also be made by varying the spatial distance between the PTC thermistor and the bidirectional breakdown voltage component.

A transildiode or varistor can be used, for example, as the bidirectional breakdown voltage component. Two oppositely polarized Z-diodes connected in series are also suitable for forming the bidirectionally acting breakdown voltage component.

The breakdown voltage of the bidirectional breakdown voltage component is advantageously selected so that it lies below the ignition voltage and above the arc voltage of the discharge lamp. It is thereby achieved on the one hand that in the preheating phase of the lamp current flows through the preheating circuit comprising the PTC thermistor and the bi-directional breakdown voltage component, and thus the electrodes are preheated while the gas discharge has not yet been ignited.

On the other hand, after ignition of the gas discharge, during the combustion phase of the lamp, no more current flows in the preheating circuit. Then the peak voltage lies below the breakdown voltage. The bidirectional breakdown voltage component blocks and the preheating circuit represents no additional load.

Preferably the PTC thermistor and the bidirectional breakdown voltage component are integrated in one structural element.

The invention will now be explained in detail by means of an exemplary embodiment, making reference to the drawing figure.

The single figure in the drawings shows a circuit diagram of the circuit arrangement according to the invention.

There is shown a rectifier 1 with a smoothing unit, a DC/AC converter 2 and a load circuit 3. The load circuit 3 contains the inductance L1 which is connected in series with the parallel circuit of the discharge lamp Hi with at least one capacitor C1 as the capacitance. The series circuit of a PTC thermistor V1 and a transildiode V2 is likewise arranged parallel to the capacitor C1.

The PTC thermistor V1 and the transildiode V2 are preferably coupled together thermally by means of varnish which is shown by the dotted connection of the two components. The capacitors C2 and C3 serve both for the alternating current coupling and for smoothing the supply voltage.

The DC/AC converter 2 supplies a square-wave voltage of about 310 Vss. At the start of the DC/AC converter 2, the current flows in the load circuit 3 through the inductance L1, the heating coils of the lamp electrodes and the capacitor C1, the PTC thermistor V1 and the transildiode V2.

The breakdown voltage of the transildiode V2 is calculated such that the discharge lamp Hi does not ignite spontaneously, but that heating of the electrodes is assured. Owing to the thermal coupling between the PTC thermistor V1 and the transildiode V2 the PTC thermistor V1 is additionally heated up by the waste heat of the transildiode V2. As the PTC thermistor V1 heats up, its resistance and thus the resonance rise at the discharge lamp Hi increases until the latter ignites.

When the discharge lamp Hi burns, the peak voltage of the discharge lamp H1 lies below the breakdown voltage of the transildiode V2. The preheating circuit is blocked and thus represents no additional load.

We claim:

1. A circuit arrangement for operating a discharge lamp comprising:

a source of high frequency electrical pulses;

an inductor element connected in series with the lamp;

means for coupling the source to the series connection of the inductor element and the lamp to energize the lamp;

a capacitor element connected in parallel with the lamp;

a bi-directional breakdown device;

a PTC resistor connected in series with the breakdown device;

means for connecting the PTC resistor and the breakdown device in parallel with one of the elements; and a thermal coupling between the PTC resistor and the breakdown device to heat the PTC resistor with the heat loss from the breakdown device.

2. The circuit arrangement of claim 1, in which the PTC resistor and the breakdown device are integrated into one structural element to establish thermal coupling therebetween.

3. The circuit arrangement of claim 1, in which the thermal coupling comprises a connecting medium between the PTC resistor and the breakdown device wherein the degree of thermal coupling is dependent on the connecting medium.

4. The circuit arrangement of claim 3, in which the connecting medium is varnish.

5. The circuit arrangement of claim 3, in which the connecting medium is adhesive.

6. The circuit arrangement of claim 1, in which the breakdown device is a transildiode.

7. The circuit arrangement of claim 1, in which the breakdown device comprises two Z-diodes connected at opposite poles.

8. The circuit arrangement of claim 1, in which the breakdown device is a varistor.

9. The circuit arrangement of claim 1, in which the breakdown voltage of the breakdown device lies between the ignition voltage and the combustion voltage of the lamp.

10. The circuit arrangement of claim 1, in which the source comprises a rectifier to convert AC house current to direct current and an inverter to generate high frequency pulses from the direct current.

* * * * *

UNITED STATES PATENT AND TRADEMARK OFFICE

CERTIFICATE OF CORRECTION

PATENT NO. : 5,543,690

DATED : August 6, 1996

INVENTOR(S) : Erhard Bernicke; Klaus Rohr; Karl Eibisch

It is certified that error appears in the above-indentified patent and that said Letters Patent is hereby corrected as shown below:

Column 2, line 29, change "attained" to -- achieved --.
Column 3, line 62, change "Hi" to -- H1 --.
Column 4, lines 11,17,19, change "Hi" to -- H1 -- (all occurrences).
Column 4, line 63, before "current" delete "house".

Signed and Sealed this

First Day of July, 1997

Bruce Lehman

*Attest:*

BRUCE LEHMAN

*Attesting Officer*

*Commissioner of Patents and Trademarks*